US006491615B1

(12) United States Patent
Campbell, Jr. et al.

(10) Patent No.: US 6,491,615 B1
(45) Date of Patent: Dec. 10, 2002

(54) ROTOR LOCATOR

(75) Inventors: Glenn M. Campbell, Jr., Maple Grove; Douglas J. Kluge, Clearwater; Glenn M. Campbell, Sr., Plymouth; Ellen M. Heath; Ruth Shuman, both of Minnetonka, all of MN (US)

(73) Assignee: Gentra Systems, Inc., Plymouth, MN (US)

( * ) Notice: Subject to any disclaimer, the term of this patent is extended or adjusted under 35 U.S.C. 154(b) by 0 days.

(21) Appl. No.: 09/637,777

(22) Filed: Aug. 11, 2000

(51) Int. Cl.[7] ..... B04B 9/00; B04B 13/00

(52) U.S. Cl. ..... 494/10; 494/20; 494/84

(58) Field of Search ..... 494/1, 10, 12, 494/16, 20, 31, 33, 47, 82, 84, 85; 422/72; 74/572

(56) References Cited

U.S. PATENT DOCUMENTS 3,073,517 A * 1/1963 Pickels et al.
3,317,127 A * 5/1967 Cole
3,581,981 A * 6/1971 Latham, Jr.
4,015,774 A * 4/1977 Taylor
4,140,268 A * 2/1979 Lacour
4,184,524 A * 1/1980 Lorenz
4,484,907 A 11/1984 Sheeran, Jr.
4,927,545 A * 5/1990 Roginski
5,104,372 A * 4/1992 Rossetto
5,312,319 A * 5/1994 Salter
5,322,497 A * 6/1994 Kobayashi
5,505,683 A * 4/1996 Geringer et al.
5,730,697 A * 3/1998 Auchinleck
5,769,775 A * 6/1998 Quinlan et al.
6,060,022 A * 5/2000 Pang et al.
6,196,961 B1 * 3/2001 Hoshiba et al.

FOREIGN PATENT DOCUMENTS

EP 0 192 571 8/1986
WO WO 99/21658 5/1999

* cited by examiner

*Primary Examiner*—Charles E. Cooley
(74) *Attorney, Agent, or Firm*—Leffert Jay & Polglaze P.A.

(57) ABSTRACT

A rotor locator and centrifuge body locator includes a pair of locator arms that close about the rotor shaft and an alignment pin to center the rotor shaft. A registration mechanism rotates the rotor shaft and the centrifuge body until it reaches a known home position. A method of consistently registering the centrifuge body includes centering a rotor shaft of the body along a known center line and aligning the body to a home position both before and after centrifugation. A centrifuge employs the rotor locator and operates using the method. The centrifuge may also include a bucket stop for maintaining proper orientation of centrifuge buckets during registration.

10 Claims, 4 Drawing Sheets

Fig. 2
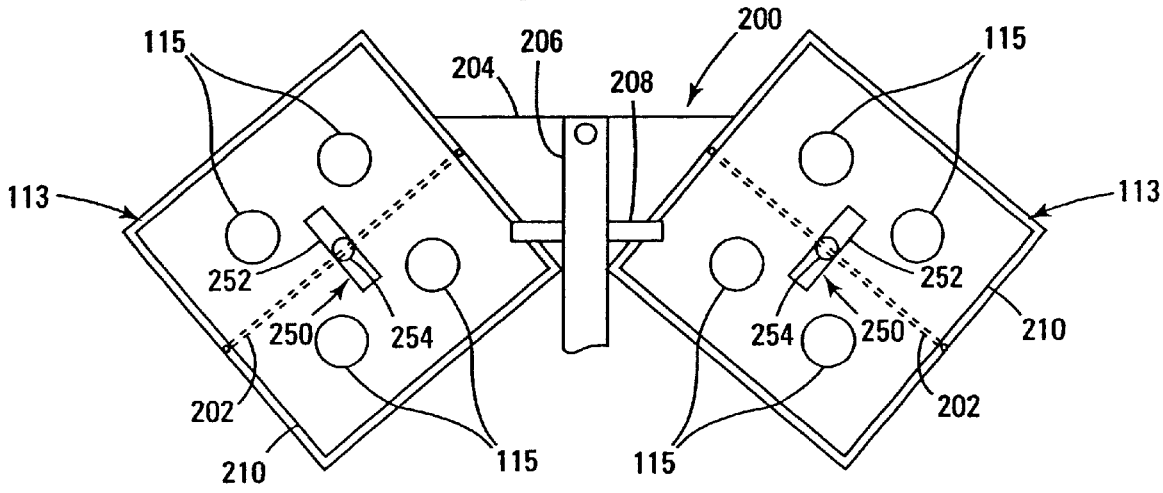
Fig. 3
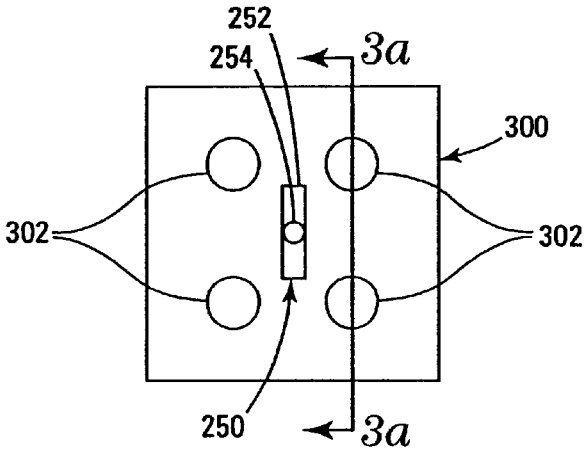
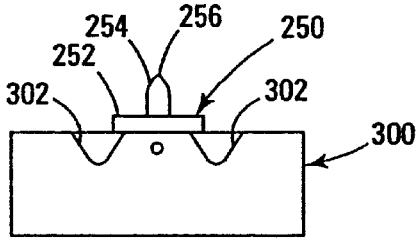
Fig. 3a

ROTOR LOCATOR

The present invention relates generally to rotor location, and more specifically to rotor location of a floating rotor.

BACKGROUND

Centrifuges and other equipment for separating particles in suspension operate by spinning tubes or other containers containing the suspension at high angular rotational speeds. Centrifugation is common in medical testing, purification of samples, and other such endeavors. The high speeds of revolution in a centrifugation process are typically in the range of 2700 revolutions per minute (RPM) and higher. In order to accomplish such high speeds of revolution, it is necessary to use high speed motors and special precision equipment.

When multiple samples are placed in a centrifuge, each must be labeled carefully, because the high rotational speeds and the sheer number of rotations that the centrifuge contents undergo makes it very difficult to stop rotation of the centrifuge bucket exactly where it started. Typically, when multiple samples are placed into a centrifuge, each sample is labeled or coded, and placed individually by a technician or other operator into the centrifuge. After completion of the centrifuging operation, the samples are typically removed, again by a technician or other operator, identified by the labeling, and cataloged, stored, or used accordingly.

Recently, an automated procedure and apparatus allowing for robotic placement of multiple samples into a centrifuge was disclosed in greater detail in co-owned U.S. patent application Ser. No. 09/420,965, pending, assigned to the assignee of the present application, which is herein incorporated by reference in its entirety. Operation of such an apparatus may be controlled by use of a computer-control system such as those disclosed in co-owned U.S. patent application Ser. Nos. 09/255,146, pending and Ser. No. 09/361,829, pending, which are also herein incorporated by reference in their entirety. Such procedures and apparatuses place samples into centrifuging stations or centrifuges for operation of certain separating processes performed by the centrifuges.

Rotors of typical centrifuges, because of their extremely high speeds of rotation, typically "float" in an approximate circular pattern while they rotate. The rotation is driven by a belt drive connected to a motor off to the side of the centrifuge bucket. The rotor shaft operates through the use of a special bearing assembly which allows the rotor shaft to float, which in turn allows for out of balance rotation, or unbalanced loads in the centrifuge bucket. In other words, the axis of rotation of the rotor shaft is not closely constrained. When the centrifuge rotation is slowing down and eventually stops, there is generally no reliable method for determining without visual confirmation the angular position of the bucket. Therefore, samples placed in the centrifuge are difficult to remove with an automated process, without further analysis of the samples, such as reading bar codes or the like.

When using an automated process for placing samples in a centrifuge bucket, and an automated process for removing the samples when centrifugation is complete, it would be desirable to allow for removal of the samples in the order in which they were placed in the centrifuge, or in reverse order. It would also be desirable to be able to remove samples without the need for supervision by a technician or operator of the equipment.

Further, when samples are placed in a centrifuge bucket, they may be placed in such a position that the centrifuge bucket is unbalanced, and rocks off its gravitational center. In such a situation, an automated process for removing samples, which need to be precise for correct operation, may have difficulty aligning with the centrifuge bucket after a centrifugation operation.

SUMMARY

The present invention overcomes the problems of the prior art by providing in various embodiments methods and apparatuses for location of the rotor of a centrifuge, for accurately determining the rotational position of a centrifuge bucket, and for aligning a centrifuge bucket to aid an automated process for removal of samples from the centrifuge bucket.

In one embodiment, a rotor locator for a centrifuge includes first and second locator arms each having a notch. The notches align when the locator arms move between a first position in which the arms are separated, and a second position in which the arms are substantially aligned along one edge. The notches form around a locator pin when the rotator arms move to their second position.

In another embodiment, a centrifuge includes a rotatable centrifuge body with a number of centrifuge buckets and a cover, a drive motor coupled to a rotor shaft to rotate the centrifuge body, and a rotor locator to move the centrifuge body to a known position.

In yet another embodiment, a method for locating a centrifuge body includes centering a rotor shaft of the body along a known center line, aligning the body to a home position, and placing samples in one or more centrifuge buckets. Once the samples have been placed, they are centrifuged. When centrifuging is completed, the method further includes re-centering the rotor shaft along the known center line, re-aligning the centrifuge body to its known home position, and removing the samples.

Other embodiments are described and claimed.

BRIEF DESCRIPTION OF THE DRAWINGS

FIG. 2 is a top view of an embodiment of a bucket stop according to one embodiment of the present invention;

FIG. 3 is a side view of a bucket embodiment of the present invention;

FIG. 3*a* is a cutaway view taken along lines 3*a*—3*a* of FIG. 3.

DETAILED DESCRIPTION

In the following detailed description of the embodiments, reference is made to the accompanying drawings which form a part hereof, and in which is shown by way of illustration specific embodiments in which the invention may be practiced. It is to be understood that other embodiments may be utilized and structural or logical changes may be made without departing from the scope of the present invention.

Figure 1:
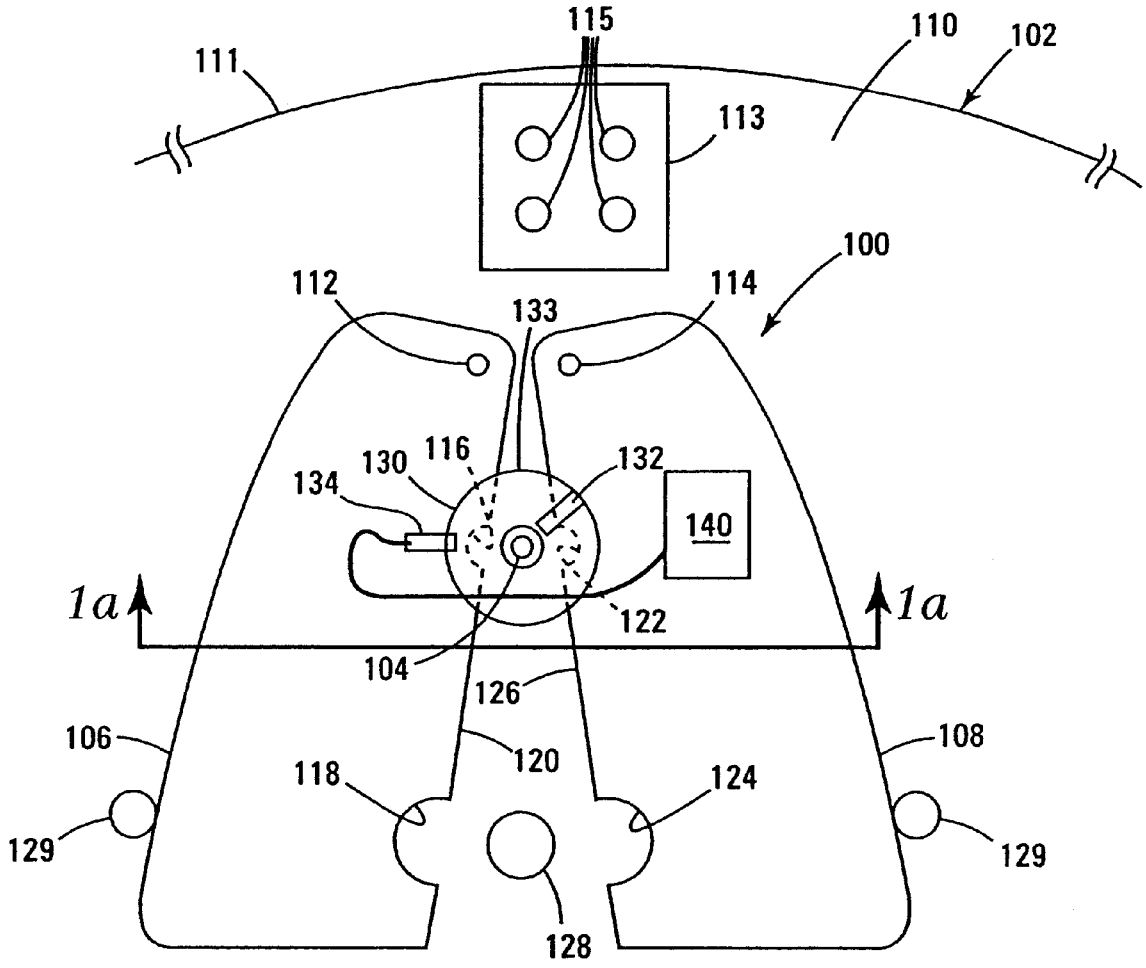
FIG. 1 is a top view of a rotor locator according to one embodiment of the present invention.

FIG. 1 is a top view of an embodiment 100 of a centrifuge rotor locator. The centrifuge rotor locator 100 is positioned on centrifuge 102 to allow the rotor locator 100 to center the rotor shaft 104 before or after a centrifugation process. As has been described above, the centrifuge rotor shaft 104 typically floats, that is it is not constrained to a certain axis of rotation. Instead, the rotor shaft is free to float, maintaining the extremely high revolutions of the centrifuge without placing undue strain on the rotor shaft 104.

The centrifuge rotor locator 100 in one embodiment includes a pair of locator arms 106 and 108 which are mounted to a cover 110 of the centrifuge 100. Each of the locator arms 106 and 108 is mounted so as to be movable from a first centrifuge operating position where the arms are separated and a second locating position where the arms are together. Locator arm 106 has in one embodiment a pair of notches 116 and 118 positioned along one edge 120 thereof. Locator arm 108 has in one embodiment a pair of notches 122 and 124 positioned along one edge 126 thereof. In this embodiment, the edges 120 and 126 are aligned so that they face one another, and when the locator arms 106 and 108 rotate about their respective pivot points, 112 and 114, toward each other, the edges 120 and 126 meet, creating two openings. The first opening in one embodiment is a substantially circular opening which is comprised of the two substantially half circle notches 116 and 122.

In one embodiment, the locator arms are each movable between the first and the second positions by rotation about first and second pivot points, pivot point 112 for locator arm 106, and pivot point 114 for locator arm 108.

The second opening in one embodiment is also a substantially circular opening formed of a combination of notches 118 and 124. The notches 116 and 122 form the first opening to locate the rotor shaft 104 by confining its position to within the first opening. In this embodiment, shaft 104 has affixed or attached thereto a rotor shaft bearing 105 which has an outside diameter greater than the rotor shaft, and the notches 116 and 122 close about the bearing, thereby constraining not only the bearing 105 but also the rotor shaft 104. The notches 116 and 122 in this embodiment form an opening substantially the size of the bearing 105 to constrain the bearing 105 and rotor shaft 104 to a known position when the locator arms close to their locating position.

In this embodiment, the notches 118 and 124 contact pin 128 which is positioned so as to register the position of the rotor shaft 104 as it is confined into position to allow location of the rotor shaft. The pin 128 and the rotor shaft 104 are positioned in one embodiment in alignment so that the rotor shaft is centered when the locator arms 106 and 108 close about the pin 128.

At the same time the locator arms close about the pin 128, the notches 116 and 122 close about the shaft bearing 105. Once the locator arms 106 and 108 close about the shaft bearing 105 and the pin 128, the rotating portion 111 of the centrifuge body is registered and located by using a registration mechanism to ensure that the position of the centrifuge body is known to a high degree of certainty. When the position of the centrifuge body 111 is known, the position of the individual sample holders or buckets 113 in the centrifuge body are also known.

In this embodiment, the notches 116 and 122 and the bearing 105 are sized so as to allow the cover of the centrifuge clearance to be opened without obstruction. The larger openings allowed by the use of the bearing 105 allow the cover of the centrifuge to be opened and still clear the rotor locator mechanism of the present invention.

In another embodiment, bearing 105 surrounding rotor shaft 104 is not present, and the notches 116 and 122 of locator arms 106 and 108 close instead about the rotor shaft 104 itself.

Figure 1A:
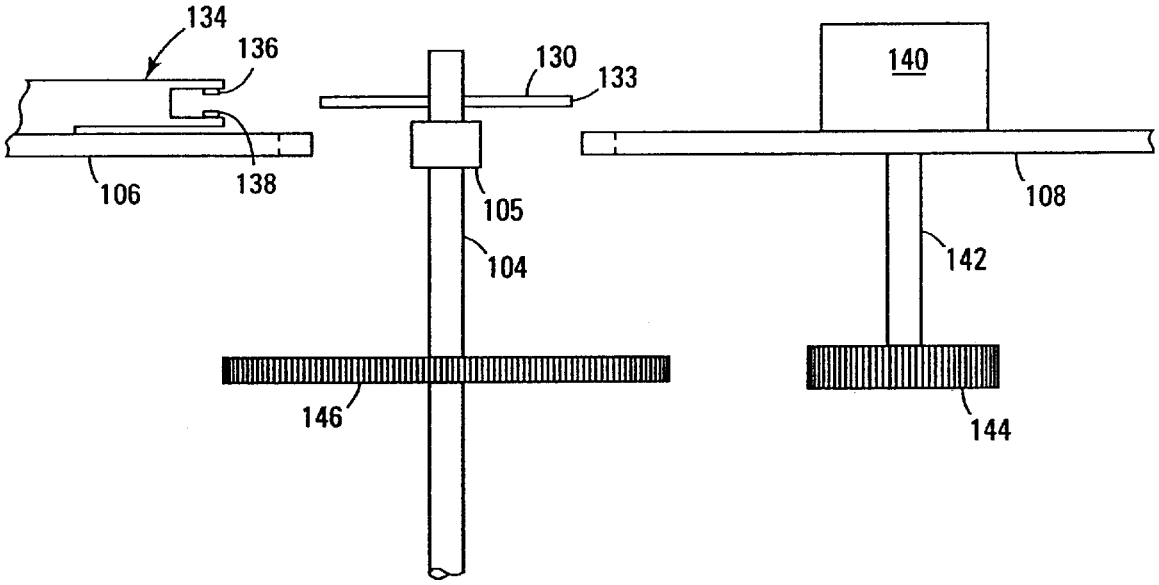
FIG. 1*a* is a view of the embodiment of FIG. 1 taken along lines 1*a*—1*a* thereof.

In another embodiment, the registration mechanism comprises a registration disk 130 fixedly attached to the rotor shaft 104. The registration disk 130 therefore rotates with the rotor shaft 104. The registration disk in one embodiment has a notch or slot 132 cut or formed therein radially inward from the circumferential edge 133 of the disk 130 toward the rotor shaft 104. An optocoupler 134 having a transmitter 136 and a receiver 138 is positioned so that the transmitter 136 and the receiver 138 are located on either side of the registration disk 130, as is best shown in FIG. 1*a*.

The transmitter emits a light signal. When the disk 130 is between the transmitter 136 and the receiver 138, the light signal is blocked by the disk and is not received at the receiver. When the slot 132 is interposed between the transmitter and the receiver, the receiver receives the light signal from the transmitter. The receipt of the light signal indicates to logic in an attached motor 140 that controls motion of a gear or other movement mechanism (FIGS. 1*a* and 1*b*) designed to accurately rotate the rotor shaft 104. The notch or slot 132 in the registration disk 130 is aligned such that the notch is identified with a home position of the centrifuge body 111. When the notch is positioned so as to allow light to be received by the receiver 138, the logic of the motor 140 and the software determine that the disk 130 is in its home position. Because the disk 130 is fixedly attached to the rotor shaft 104, the location and position of the centrifuge body 111 and buckets 113 are known with precision.

A center line of the rotor shaft is established in order to guarantee a predictable and smooth rotation to register the rotor shaft and therefore the centrifuge, even if the load in the centrifuge body is unbalanced or becomes unbalanced during rotation. When the centrifuge body is not spinning, then the rotor shaft is located so that it is centered on a known center line by closing the locator arms 106 and 108 from their first, centrifuge operating position to their second, locating position. The known center line is chosen in one embodiment of the invention to be in a position so that the rotor shaft 104, when centered on the chosen center line, is aligned so that the centrifuge body 111 is in a certain known rotational position. This known position is in one embodiment a "home" position for the centrifuge body, which in one embodiment is approximately centered in the centrifuge body. In another embodiment, the center line is chosen so as to align the rotor shaft, the pin 128, the centrifuge body in the home position, and a machine for automated loading and unloading of samples. In another embodiment, pins 129 are positioned so as to limit the travel of the locator arms 106 and 108 when the arms move to the first position.

While a home position in which the rotor shaft is approximately centered in the centrifuge body 11 provides easy registration of the rotor shaft and therefore the bucket, it should be understood that the "home" position for the rotor shaft and therefore the body may be different in different embodiments without departing from the scope of the invention.

Figure 1B:
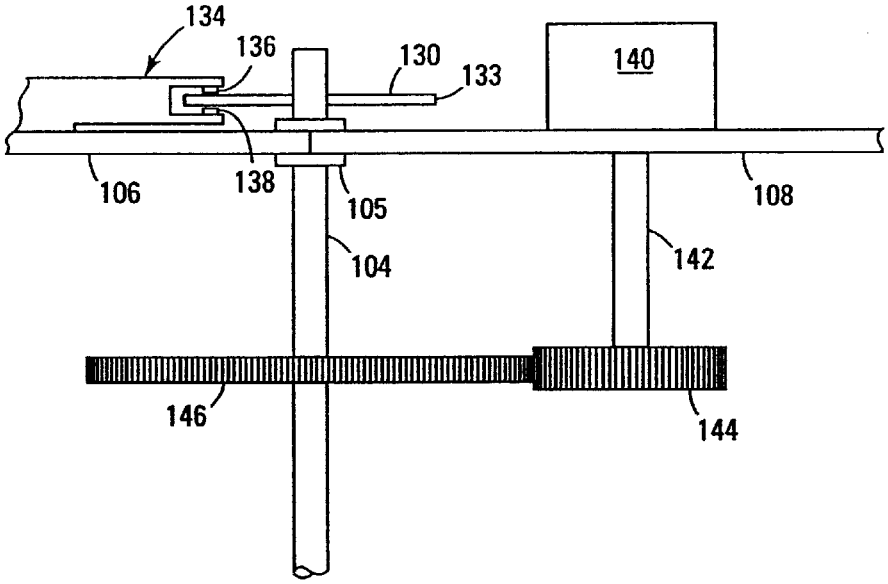
FIG. 1*b* is a view of the embodiment of FIG. 1*a* with the rotor locator in a locating position.

Referring now also to FIGS. 1*a* and 1*b*, one embodiment of a rotor locator 100 is shown in its first, centrifuge operating position (FIG. 1*a*) and its second locating position (FIG. 1*b*). In this embodiment, optocoupler 134 is positioned on locator arm 106, and motor 140 is positioned on locator arm 108, so that optocoupler 134 and motor 140 move when the locator arms 106 and 108, respectively, move. Motor 140 is coupled to motor shaft 142 which is driven by operation of the motor. Shaft 142 is coupled to motor gear 144, and rotates motor gear 144 when it rotates. Rotor shaft 104 has a rotor gear 146 affixed thereto, so that the rotor gear 146 rotates exactly with the shaft 104. The gears 144 and 146 mesh when the rotor locator is in its locating position, and rotation of the motor shaft 142 translates into rotation of rotor gear 146, which in turn rotates the centrifuge body. The gear ratio between the motor gear 144 and the rotor gear 146 is known, so that rotations of the motor shaft have a known rotational effect on the centrifuge body.

In operation, the locator arms 106 and 108, normally in their first, centrifuge operating position, are moved to their second, locating position. Movement of the locator arms in one embodiment is accomplished using a piston having a known travel, the piston attached at one end to locator arm 106 and at the other to a piston housing attached to locator arm 108. Retraction of the piston into the housing draws the locator arms together. Extension of the piston moves the locator arms apart. It should be understood that the mechanism by which the locator arms are moved may be accomplished in many different ways. It is sufficient that the mechanism is capable of drawing the arms together and moving them apart. Examples of other arm moving mechanism include,.by way of example only and not by way of limitation, gears, pistons, hydraulics, electronic solenoids, springs, and the like.

When the locator arms 106 and 108 rotate to their second locating positions, the arm notches 118 and 124 center the arms around pin 128. At the same time, the notches 116 and 122 close about the shaft bearing 105, moving it to its known center position. Also at this time, the movement of the locator arms 106 and 108 also move the optocoupler 134 into position so that the transmitter 136 and the receiver 138 are in a position in which the registration disk 130 blocks transmission of light between the transmitter and the receiver unless the notch 132 is between the transmitter and the receiver. Additionally at this time, the motor gear 144 is brought into engagement with the rotor gear 146.

The location and placement of pin 128 is chosen to make certain that the body 111 of the centrifuge is properly centered along a center line, as described above, so that the position of the centrifuge buckets 113 can be accurately and precisely determined and effected. Once the rotor shaft is centered, then the registration disc attached to the rotor shaft is used in conjunction with motor 140, motor shaft 142, motor gear 144, and rotor gear 146 to drive the rotor shaft 104. As long as the receiver 138 does not receive a light signal from the transmitter 136, the main centrifuge body is not in its home position.

When the receiver receives light from the transmitter, the centrifuge body 111 is in its home position. The home position is used in conjunction with an automated machine for introducing and removing samples as described above. Before samples are loaded, the centrifuge body 111 is moved to its home position and the exact location of the buckets 113 of the centrifuge are known. Samples are placed by the automated machine into the centrifuge buckets 113 within the centrifuge body 111 in known order, with the body being rotated by the motor 140, which is controlled by software as described above. Once all samples are loaded into the centrifuge, the rotor locator moves to its first, centrifuge operating position. Normal operation of the centrifuge for whatever purpose is desired is then performed. When spinning of the centrifuge has completed, and samples are to be removed from the centrifuge, the rotor locator is moved to its second, locating position, and the method described above is performed to once again move the centrifuge body to its home position, where the first samples placed into the centrifuge are positioned exactly where they were when the centrifuge was loaded.

FIG. 2 shows a centrifuge bucket stop 200 according to another embodiment of the present invention. Each of the centrifuge buckets 113 are freely rotatable about a post 202 which is connected to a bracket member 204. Each bracket member 204 is in turn mounted to the centrifuge body 111. When the centrifuge body 111 rotates, the buckets 113 are free to also rotate about their respective posts 202. Each of the centrifuge buckets 113 has a number of holders 115 which hold sample tubes.

Since the centrifuge, its body, and its buckets are finely calibrated precision machinery, if sample tubes are even slightly off in weight from each other, an unbalancing of the bucket, 13 may occur. In normal centrifuge operation, this is not a problem, as centrifuge manufacturers have designed centrifuges to be operable with unbalanced loads. However, since the buckets are free to rotate, when the centrifuge is used in conjunction with an automated sample loading and unloading machine as has been described above, an unbalanced load in a bucket which causes the bucket to tip can skew the bucket enough to decrease the capability of the automated machine to remove the samples from the bucket. Further, since centrifuge bodies, buckets, rotors, and moving parts are all precision made to withstand extremely high rotational speeds, it is unwise to tamper with centrifuge parts in the bucket.

The bucket stop 200 comprises a bucket stop bracket 206 and a bucket stop pin 208. The stop pin 208 is in one embodiment press fit into an opening in the stop bracket 206. The stop bracket 206 is mounted to the bracket member 204 of centrifuge bucket 11 is attached in one embodiment with existing holes and materials of the bracket member 204. In this embodiment, the stop bracket is screwed or bolted to the bracket member using an existing opening and screw or bolt of the bracket member, so as to not place any additional strain or fatigue on the bracket member. The stop pin 208 is positioned so as to limit the rotational travel of the buckets 113 located on either side of the respective stop bracket 206.

In this embodiment, the buckets 113 are restricted from rotation which would cause the holders 115 to face away from the rotor shaft 104 during rotation, or in other words, the buckets 113 are restricted from rotation which would be opposite of the expected rotation of the buckets during normal centrifuge operation. By limiting the travel of the buckets 113 , the automated machine for removing samples is able to locate exactly the samples once the centrifuge body 111 and therefore the buckets 113 are in the home position. Instead, the stop pin 208 keeps the buckets 113 at the proper angle and orientation so that the robotics and automated procedures can locate and work with the centrifuge bucket and registration procedures.

In another embodiment, each bucket includes an alignment post mechanism 250 comprising a post mechanism base 252 and an alignment post 254. The alignment post mechanism is positioned in a known location on the centrifuge bucket 113 . That known position corresponds to the known position of an opening in another portion of the mechanism that fits the alignment post 254.

In one embodiment, the alignment post is positioned in the center of each centrifuge bucket. In an automated sample loading and unloading machine as has been described above, a center screw opening is present in the loader head. This opening is aligned in this embodiment with the center screw opening of the loader head. In this embodiment, no additional openings are needed in the loader head, as the alignment post mechanism 250 takes advantage of the opening for the center screw already present in the loader head. In another embodiment, the alignment post is tapered, with the largest diameter of the alignment post being where it is attached to the mechanism base 252, tapering to its smallest diameter at the end 256 distal to the mechanism base 252.

In another embodiment, each alignment post has thereon a tapered mating piece formed from rubber or another flexible material such as a polymer, plastic, or the like. The taper of the mating piece in this embodiment or of the post in another embodiment allows a mating opening more margin for error in initial alignment with the alignment post.

In other embodiments, the position of the alignment post is determined based on post opening position of the automated apparatus. The alignment post mechanism further ensures that the automated loading of sample tubes will be precise, accurate, and repeatable over many trials.

Each of the holders 115 is precision machined in one embodiment from a holder plate 210 so that the position of the samples is determinable to a high degree of accuracy and precision. In one embodiment, a molded epoxy bottom piece 300 is placed into each of the buckets 113 , as shown in FIG. 3. This epoxy piece has supports 302, best shown in FIG. 3*a*, for supporting the bottoms of the sample tubes to prevent blowing out the tube bottoms during centrifugation. The bottom piece supports 302 also serve to maintain the sample tubes in substantially the same position they were in when they were placed in the bucket, also assisting in the removal of the sample tubes by an automated machine. In one embodiment, the supports 302 are cone shaped. However, it should be understood that the supports 302 are configured to support the bottom of whatever type of sample tube is used, and such modifications do not depart from the scope of the invention.

Figure 4:
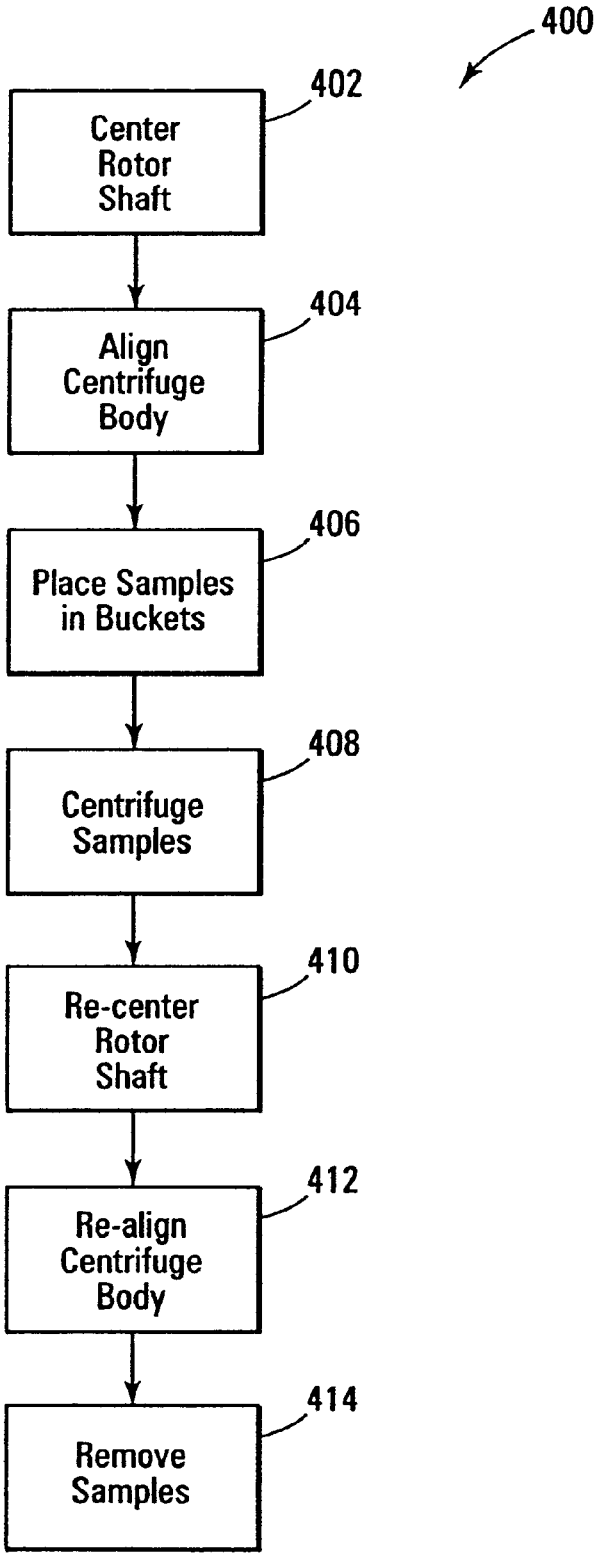
FIG. 4 is a flow chart diagram of a method embodiment of the present invention.

FIG. 4 is a flow chart diagram of a method embodiment 400 according to another embodiment of the invention. Method 400 comprises centering a rotor shaft along a known center line in block 402, aligning a centrifuge rotating body such as body 111 to a home position in block 404, and placing samples in one or more centrifuge buckets such as buckets 113 in block 406. Once samples are placed in the centrifuge body while the body is in its known home position, the samples are subjected to centrifugation as desired by the operator, computer system, method or the like in block 408. When centrifugation is complete, and the centrifuge body has stopped rotating, the position of the centrifuge rotor shaft is again centered along the known center line in block 410, and the centrifuge body is aligned to its known home position in block 412. Once the centrifuge body is aligned in its known home position, the samples are removed in block 414. The operation and process flow of blocks 402, 404, 410, and 412 are described in detail above with respect to the discussion of FIGS. 1, 1*a*, and 1b.

It is to be understood that the above description is intended to be illustrative, and not restrictive. Many other embodiments will be apparent to those of skill in the art upon reading and understanding the above description. The scope of the invention should, therefore, be determined with reference to the appended claims, along with the full scope of equivalents to which such claims are entitled.

What is claimed is:

1. A locator for a rotor having a rotor shaft, comprising:

first and second locator arms, the first and the second locator arms each having a notch therein, each of the first and the second locator arms movable between a first centrifuge operating position in which the arms are separated, and a second locating position in which the notches substantially align to form an opening when the arms are in the locating position;

a locator pin which the locator arm notches engage when the rotator arms move to their second position;

wherein each of the first and the second locator arms has a second notch therein, the second notches substantially aligning to form a second opening when the arms rotate to the second position, the second opening for constraining the rotor shaft to a predetermined position; and further comprising:

a registration mechanism to locate the rotor shaft, the registration mechanism comprising:

a motor coupled to a motor shaft;

a motor gear fixedly attached to the motor shaft;

a rotor gear fixedly attachable to the rotor shaft, the rotor gear and the motor gear engageable when the locator arms move to their second position.

2. The rotor locator of claim 1, wherein the motor is mounted to one of the first or the second locator arms.

3. The rotor locator of claim 1, wherein the registration mechanism further comprises:

a registration disc fixedly attachable to the rotor shaft about its center point, the registration disk having a notch formed therein extending from an external circumferential edge of the registration disk inward toward the rotor shaft; and an optocoupler having a transmitter and a receiver, the optocoupler positioned so as to place the registration disk between the transmitter and the receiver when the locator arms move to their second position, and the optocoupler receiver electrically coupled to the motor to provide a signal indicative of whether light is being received by the receiver.

4. The rotor locator of claim 3, wherein the optocoupler is mounted to one of the first or the second locator arms.

5. The rotor locator of claim 1, of the second notches is larger than the first notches.

6. The rotor locator of claim 5, and further comprising a bearing engageable around the rotor shaft, the second notches forming an opening that closes about the bearing to constrain the rotor shaft.

7. A rotor locator for a rotor shaft, comprising:

first and second locator arms, each arm rotatable between a first operating position in which the locator arms are separated and a second locating position in which the locator arms are substantially contacting one another along a respective edge, each of the first and the second locator arms having a first notch and a second notch along one edge thereof, the first notches of each arm substantially aligning when the arms are in the second locating position, and the second notches of each arm substantially alignable around the rotor shaft when the arms are in the second locating position;

a locator pin around which the first and second arm second notches substantially align when the arms are in the second position;

a motor having a motor shaft with a motor gear attached thereto; and a rotor gear fixedly attachable to the rotor shaft, the rotor gear engaging the motor gear when the arms are in the second locating position.

8. The rotor locator of claim 7, wherein each of the second notches is larger than the first notches.

9. The rotor locator of claim 8, and further comprising a bearing engageable around the rotor shaft, the second notches forming an opening that closes about the bearing to constrain the rotor shaft.

10. The rotor locator of claim 7, and further comprising:

a registration disc fixedly attachable to the rotor shaft about its center point, the registration disk having a notch formed therein extending from an external circumferential edge of the registration disk inward toward the rotor shaft; and an optocoupler having a transmitter and a receiver, the optocoupler positioned so as to place the registration disk between the transmitter and the receiver when the locator arms move to their second position, and the optocoupler receiver electrically coupled to the motor to provide a signal indicative of whether light is being received by the receiver.

* * * * *